US010198891B2

(12) United States Patent
Betancourt

(10) Patent No.: US 10,198,891 B2
(45) Date of Patent: Feb. 5, 2019

(54) SYSTEM AND METHOD FOR REGULATING FUEL TRANSACTIONS

(75) Inventor: Ernest Blas Betancourt, Lascassas, TN (US)

(73) Assignee: Epona LLC, Franklin, TN (US)

( * ) Notice: Subject to any disclaimer, the term of this patent is extended or adjusted under 35 U.S.C. 154(b) by 0 days.

(21) Appl. No.: 12/134,711

(22) Filed: Jun. 6, 2008

(65) Prior Publication Data

US 2009/0306997 A1 Dec. 10, 2009

(51) Int. Cl.
*G07F 13/02* (2006.01)
*G06Q 50/30* (2012.01)

(52) U.S. Cl.
CPC ..... *G07F 13/025* (2013.01)

(58) Field of Classification Search
CPC ..... G06Q 10/08; G06Q 10/10; G06Q 10/083; G06Q 10/0831; G06Q 10/0834
USPC ..... 705/1
See application file for complete search history.

(56) References Cited

U.S. PATENT DOCUMENTS 5,913,917 A * 6/1999 Murphy ..... 701/123
6,128,551 A * 10/2000 Davis et al. ..... 700/236
6,253,129 B1 6/2001 Jenkins et al.
6,292,724 B1 9/2001 Apsell et al.
6,629,029 B1 9/2003 Giles
6,714,857 B2 3/2004 Kapolka et al.
6,882,900 B1 * 4/2005 Terranova ..... 700/237
7,222,053 B2 5/2007 Snyder et al.
7,246,009 B2 7/2007 Hamblen et al.
7,362,229 B2 4/2008 Brinton et al.
2003/0163249 A1 * 8/2003 Kapolka et al. ..... 701/123
2003/0195676 A1 * 10/2003 Kelly et al. ..... 701/29
2006/0185756 A1 8/2006 Sato et al.
2006/0218056 A1 9/2006 Dickman
2007/0239346 A1 10/2007 Hawkins et al.
2007/0239614 A1 10/2007 Tannenbaum et al.
2007/0250452 A1 10/2007 Leigh et al.
2007/0262855 A1 11/2007 Zuta et al.
2008/0051939 A1 2/2008 Dobbins et al.
(Continued)

FOREIGN PATENT DOCUMENTS

JP 2006077665 3/2006

OTHER PUBLICATIONS

PCT/US2009/046069, International Search Report, dated Jul. 31, 2009.

(Continued)

*Primary Examiner* — Kira Nguyen
(74) *Attorney, Agent, or Firm* — Banner & Witcoff, Ltd.

(57) ABSTRACT

A method and system for regulating fuel transactions is provided. Fuel consumption data may be received corresponding to a first and second vehicle location. The difference between the first and second fuel consumption is determined to obtain an overall or combined fuel consumption value. In some examples, the fuel consumption data is transferred from a vehicle data system to a carrier data system located remotely from the vehicle. The data is processed at the carrier data system and the overall fuel consumption is transmitted to a fueling point to limit the amount of fuel transferred to the vehicle. In some arrangements, the limit may be adjusted to include additional factors such as additional distance to travel to the fueling point, anticipated distance to be traveled in subsequent legs of the trip, etc.

23 Claims, 5 Drawing Sheets

(56) References Cited

U.S. PATENT DOCUMENTS

2008/0319605 A1* 12/2008 Davis ..... G01F 9/008
701/33.4
2009/0152346 A1* 6/2009 Granruth ..... G06Q 50/30
235/381

OTHER PUBLICATIONS

PCT/US2009/046069, Written Opinion, dated Jul. 31, 2009.
Networkcar Introduces DataConnect Service, http:/news.thomasnet.com/fullstory/483067, dated printed May 14, 2008.
Used Freightliner Truck Fuel Economy, http://www.fleetsalesonline.com/Fuel_Economy.htm, dated printed May 14, 2008.
Sep. 14, 2015—(CA) Examiner's Report—App. No. 2,724,537.
Sep. 7, 2016 (CA) Examiner's Report—App 2,724,537.
Jul. 19, 2017—(CA) Examiner's Report—App 2,724,537.
Sep. 21, 2018—(CA) Examination Report—App 2,724,537.

* cited by examiner

SYSTEM AND METHOD FOR REGULATING FUEL TRANSACTIONS

FIELD OF ART

The invention relates generally to a method and a system for regulating fuel transactions for commercial vehicles, such as commercial trucks, fleet vehicles, and the like. Specifically, the invention relates to a system and method for limiting the amount of fuel transferred to a vehicle at a particular fueling location.

BACKGROUND

With today's seemingly endless rising gas prices, the issue of fuel fraud in the transportation industry is a hot topic. Having commercial trucking industry drivers or fleet vehicle drivers fueling vehicles with inadequate or inefficient safeguards in place may cost the trucking industry millions of dollars each year due to fuel theft and/or fuel fraud. For example, insufficient limits on the amount of fuel that may be transferred to a vehicle can result in fuel being transferred to unauthorized vehicles. Accordingly, fuel transaction limits are generally used to regulate the amount of fuel that can be transferred to a vehicle during a particular fueling transaction. However, these limits are typically generic limits, such as a daily limit on the amount of fuel that can be transferred to a vehicle, and do not provide sufficient safeguards in view of the above-identified security holes.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

The present application describes a system and method for regulating fuel transactions that may provide industries with some protection against fuel fraud, theft, and the like. The method and system generally include determining, at a first vehicle location, a first fuel consumption. In addition, a second fuel consumption is determined at a second vehicle location. This fuel consumption information may be transmitted to a carrier data system where it is processed to determine the difference between the fuel consumption at the first and second vehicle locations. This difference is then transmitted to the fueling location of the vehicle and is used as a limit or is used to determine a limit to the amount of fuel that can be transferred to the vehicle at that fueling location.

In some arrangements the determined fuel consumption may be adjusted for various factors. For instance, the second vehicle location at which the second fuel consumption is determined may be a certain distance from the fueling point. Accordingly, the fuel consumption may be adjusted to include the additional consumption needed to reach the fueling point. This adjusted fuel consumption will then be transmitted to the fueling point to act as a limit to the amount of fuel to be transferred to the vehicle.

These as well as other advantages and aspects of the invention are apparent and understood from the following detailed description of the invention, the attached claims, and the accompanying drawings.

BRIEF DESCRIPTION OF THE DRAWINGS

The present invention is illustrated by way of example and not limited in the accompanying figures in which like reference numerals indicate similar elements and in which.

DETAILED DESCRIPTION

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

Figure 1:
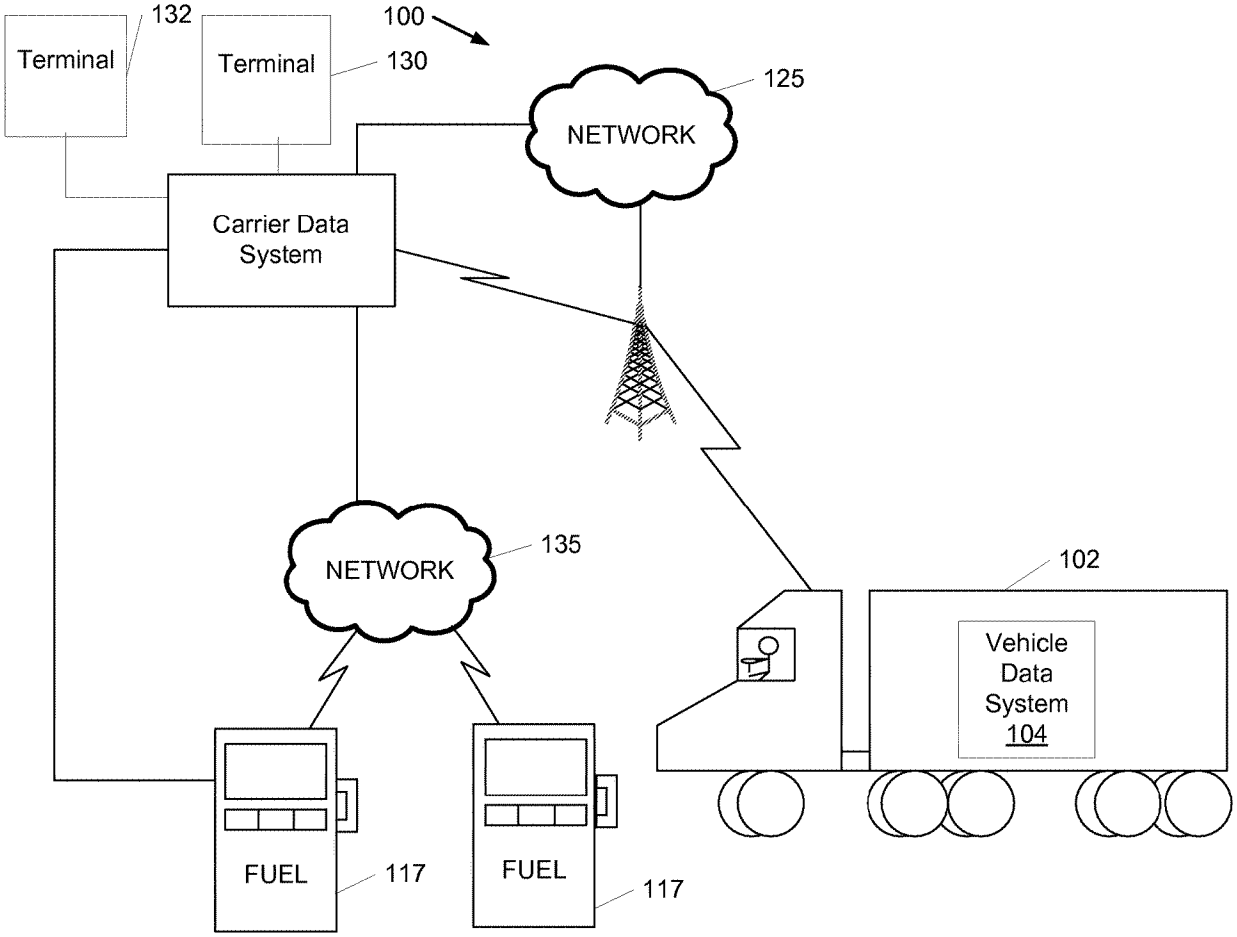
FIG. 1 illustrates a fuel transaction regulating system according to one or more aspects described herein.

FIG. 1 illustrates a vehicle fuel regulating transaction processing system 100 configured to function with various vehicles, such as commercial tractor trailers, for instance truck 102, company service vehicles or, more generally, any fleet vehicle. A fleet vehicle, as used herein, may be any vehicle operating on fuel and may include vehicles requiring authorization to transfer fuel to the vehicle. Additionally or alternatively, a fleet vehicle may include any vehicle that includes cumulative fuel consumption data, other fuel expense related information, as well as various other types of internal vehicle information. The fuel transaction regulating processing system 100 may provide a limit to the amount of fuel that may be transferred to a given vehicle at a particular fuel station in a particular fuel transaction. That is, the amount of fuel that may be transferred to truck 102 in a given fueling stop may be limited by the system and method described herein. In one arrangement, the amount of fuel transferred is limited by a received fuel consumption, as will be discussed more fully below.

In conventional fuel transaction processing systems, the amount of fuel a vehicle can obtain at a given fueling transaction may be limited by a variety of factors. For instance, the amount of fuel authorized for transfer may be based on distance traveled, time of the trip, and the like. Additionally or alternatively, the amount of fuel authorized for transfer to a vehicle may be predetermined by a daily limit that is based on estimated time and distance to be traveled, etc.

The system and method described herein provides vehicle-specific fuel limits, i.e., fuel limits for each particular vehicle, based on data received from that particular vehicle. With reference to FIG. 1, for instance, various data points may be stored locally on a vehicle in a vehicle data system 104. For instance, truck 102 may have a vehicle data system 104 that stores data such as odometer readings, latitude and longitude of the vehicle (i.e., location), fuel transferred to the vehicle, cumulative fuel consumption, and the like. In some arrangements, the vehicle data system 104 may store data for a given trip. Additionally or alternatively, the vehicle data system 104 may store vehicle data for all trips in a predetermined time period, e.g., one week, one month, etc. In still other arrangements, the vehicle data system may store cumulative information for all vehicle trips.

The vehicle data system 104 may also be configured to connect to a network 125 (e.g., the Internet, through which the vehicle may connect to a home or corporate network). The connection to the network 125 may be made using known methods of wireless connection, such as satellite, WiFi, cellular, etc. The vehicle data system may include one or more vehicle data buses associated with or configured on a vehicle. Additionally or alternatively, the vehicle data system may include an engine control monitor from which the data collected and used by the vehicle data system is extracted or received. In some arrangements, the vehicle data system may include a global positioning system (GPS) to provide information regarding the location of the vehicle (i.e., longitude, latitude, etc.).

Data stored in the vehicle data system 104 may be transmitted, via the network 125, to a central processing server, such as carrier data system 106. The carrier data system 106 may be located remotely from the vehicle. In some arrangements, the carrier data system 106 may be located in the vehicle. Transfers of data from the vehicle data system 104 to the carrier data system 106 may occur at predetermined times throughout the day or at regular intervals throughout the day. Additionally or alternatively, the data transfer may occur frequently enough to permit real-time, or nearly real-time data to be processed at the carrier data system 106. Further still, on-demand transfers of data may be conducted as needed, in either a push or pull data transfer scheme. That is, an operator or other requester at the carrier data system 106 or at the vehicle 102 may initiate an on-demand transfer of the data from the vehicle data system 104 at any time.

Data transferred to the carrier data system 106 may be stored on the carrier data system 106. Additionally or alternatively, the data transferred to the carrier data system 106 may be processed to determine various performance characteristics of the vehicle 102. For instance, the carrier data system 106 may process the data transferred to determine average fuel mileage for the vehicle, general efficiency of the vehicle, fuel consumption, and the like.

Figure 2:
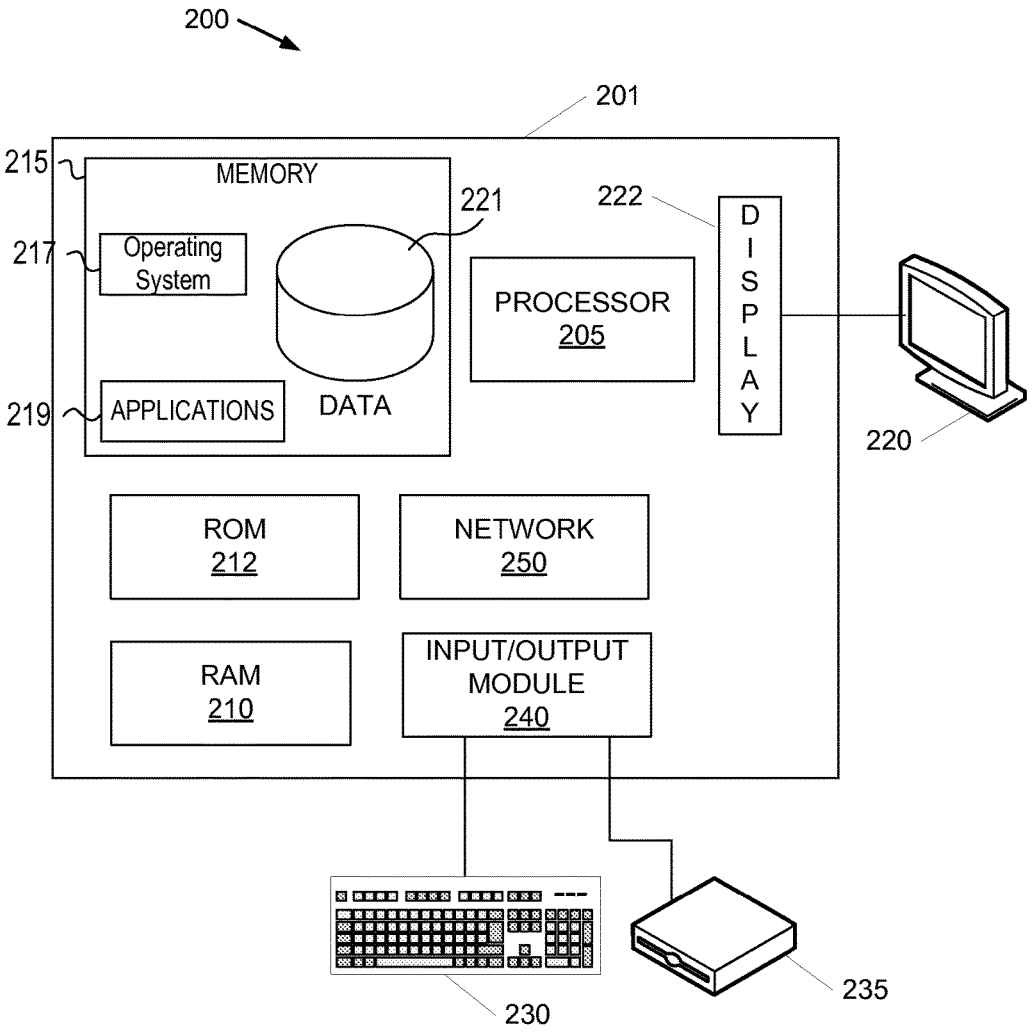
FIG. 2 illustrates one illustrative computing environment that may be used in accordance with the fuel transaction regulating system described herein.

FIG. 2 illustrates a block diagram of a computing environment 200 including a generic computing device 201 (e.g., a computer server) that may be used according to an illustrative embodiment of the invention. For instance, the vehicle data system (104 in FIG. 1) and/or the carrier data system (106 in FIG. 1) may include a computing environment similar to computing environment 200 shown in FIG. 2. The computer 201 may have a processor 205 for controlling overall operation of the server and its associated components, including RAM 210, ROM 212, input/output (I/O) module 240, and memory 215.

Software may be stored within memory 215 and/or storage to provide instructions to processor 205 for enabling server 201 to perform various functions. For example, memory 215 may store software used by the server 201, such as an operating system 217, application programs 219, and an associated database 221. Alternatively, some or all of server 201 computer executable instructions may be embodied in hardware or firmware (not shown). As described in detail below, the database 221 may provide centralized storage of transport information such as mileage information, fuel consumption, position of vehicles, and the like, allowing interoperability between different elements of the business residing at different physical locations. Input/output module 240 may include a microphone, keypad, touch screen, and/or stylus through which a user of device 201 may provide input, and may also include a video display device for providing audiovisual and/or graphical output.

The computing environment 200 may operate in a networked environment supporting connections to one or more remote computers, such as terminals 130 and 132 shown in FIG. 1. The terminals 130 and 132 may be personal computers or servers that include many or all of the elements described above relative to the server 201. In addition, the computing environment 200 may support connections to various vehicles (102 in FIG. 1) and/or fueling stations (117 in FIG. 1). The network connections depicted in FIG. 2 may include a local area network (LAN) (not shown) and a wide area network (WAN) (not shown), but may also include other communication networks, such as satellite, cellular, WiFi, etc. These and other communication networks may be used for communication between one or more vehicles 102, i.e., the vehicle data system, and the carrier data system, between the carrier data system and the fueling point, and the like. When used in a LAN networking environment, the computer 201 may be connected to the LAN through a network interface or adapter. When used in a WAN networking environment, the server 201 may include a modem or other means for establishing communications over the WAN, such as the Internet. It will be appreciated that the network connections shown are illustrative and other means of establishing a communications link between the computers may be used. The existence of any of various known protocols such as TCP/IP, Ethernet, FTP, HTTP and the like is presumed, and the system can be operated in a client-server configuration to permit a user to retrieve web pages from a web-based server. Any of various conventional web browsers can be used to display and manipulate data on web pages.

Computing device 101 and/or terminals 130 or 132 may also be mobile terminals including various other components, such as a battery, speaker, and antennas (not shown).

The invention is operational with numerous other general purpose or special purpose computing system environments or configurations. Examples of well known computing systems, environments, and/or configurations that may be suitable for use with the invention include, but are not limited to, personal computers, server computers, hand-held or laptop devices, multiprocessor systems, microprocessor-based systems, set top boxes, programmable consumer electronics, network PCs, minicomputers, mainframe computers, distributed computing environments that include any of the above systems or devices, and the like.

The invention may be described in the general context of computer-executable instructions, such as program modules, being executed by a computer. Generally, program modules include routines, programs, objects, components, data structures, etc. that perform particular tasks or implement particular abstract data types. The invention may also be practiced in distributed computing environments where tasks are performed by remote processing devices that are linked through a communications network. In a distributed computing environment, program modules may be located in both local and remote computer storage media including memory storage devices.

In one arrangement, data collected at the vehicle data system 104 may relate to fuel consumption, such as cumulative fuel consumption. The data collected may be transferred, via the network 125, to the carrier data system 106 that may include a computing environment as shown in FIG. 2. The data may be stored at the carrier data system 106 and/or processed. For instance, data may be processed to determine performance characteristics of the vehicle 102, such as efficiency, fuel mileage, fuel consumption for a leg of a trip, and the like. One or more of these determined characteristics may be used to limit the amount of fuel transferred to a vehicle 102 at a fueling station in a particular fueling transaction.

With further reference to FIG. 1, one or more fueling stations 117 may be connected, via a network 135, to the carrier data system 106. As shown in FIG. 1, the fueling stations 117 may be connected to the carrier data system 106 via a second network 135, separate from the network 125 connecting the vehicle data system 104 and the carrier data system 106. Alternatively, a single network may connect the vehicle data system 104, carrier data system 106 and the fueling stations 117.

The data processed by the carrier data system 106 may be used to determine a limit to the amount of fuel to transfer to a particular vehicle at a particular fueling transaction. This fuel limit information may be transmitted, via the network 135, from the carrier data system 106 to the fueling station 117 at which the fuel transfer will occur. The communication between the fueling station 117 and the carrier data system 106 may be done using known methods of communication/networking and may use any of several known communication protocols. In addition, the process of regulating the amount of fuel to be transferred and authorization of the transfer may be performed using any of several known methods. One such method of authorizing fuel transaction processes is disclosed in U.S. patent application Ser. No. 11/678,110, entitled "System and Method for Processing Vehicle Transactions" and filed on Feb. 23, 2007, herein incorporated by reference for all purposes.

Figure 3:
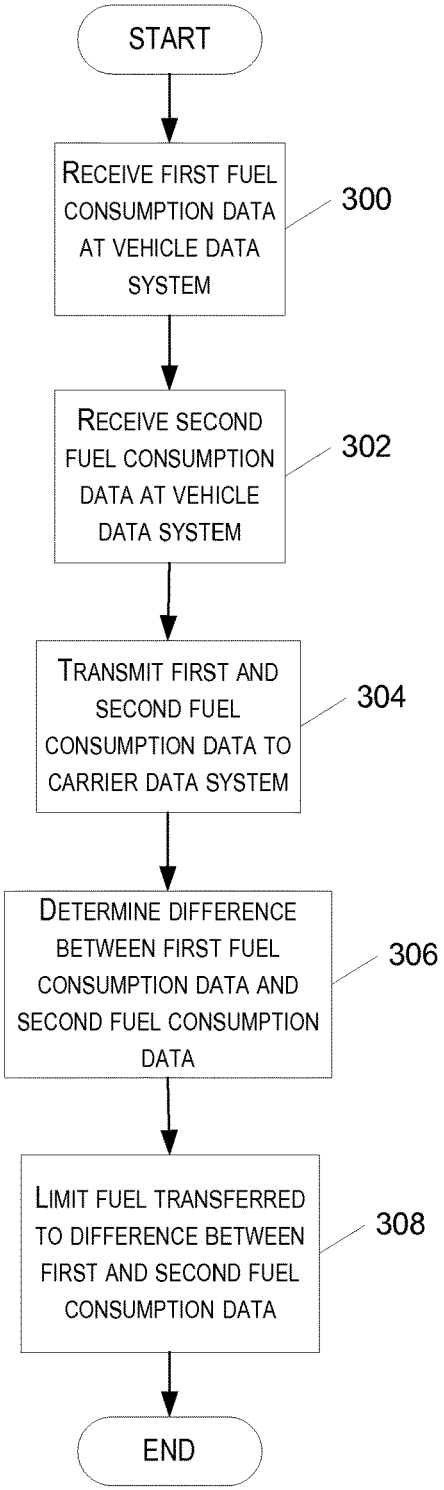
FIG. 3 is a flowchart illustrating a method of regulating fuel transactions according to one or more aspects described herein.

FIG. 3 depicts a flowchart for an illustrative method of regulating fuel transactions according to one or more aspects of the invention. The vehicle data system 104 collects data for fuel consumption, odometer readings, latitude and longitude, etc. of the vehicle 102 at various points in a trip. In step 300, the vehicle data system 104 receives fuel consumption data for a first point, point A. For instance, the vehicle data system may take a reading of the cumulative fuel consumption at point A. In some examples, the fuel consumption data is a volumetric measure of the amount of fuel consumed. In some arrangements, the cumulative fuel consumption data may be received from the engine control monitor and/or one or more data buses associated with the vehicle. As used herein, the term "received" may include extracting, reading, determining, identifying, collecting, and the like, both raw data that is extracted from at least one of the data bus and engine control monitor and that has not been processed or been included in any calculation, as well as precalculated data that has been processed or included in a calculation, and the like. In step 302, the vehicle data system 104 receives at least one additional data point for fuel consumption at a later point in a trip, point B. For example, the vehicle data system may take a second reading of the cumulative fuel consumption data at point B. This data is then transmitted to the carrier data system 106 in step 304, where the difference between the two fuel consumption data values is determined in step 306. In one example, point A will be a point at or near the beginning of a trip, and point B will be a point at or near a fueling point, such as a first fuel stop in a trip. The determined difference in fuel consumption between these two points is generally the fuel consumed for that leg of the trip. In step 308, this information is transmitted to the fueling station 117 to act as a limit to the amount of fuel that may be transferred to the vehicle 102 at the upcoming fuel stop. In some arrangements, the difference between the fuel consumption values determined is the only limit used for determining the amount of fuel transferred to the vehicle 102. In other arrangements, additional factors, characteristics, etc. may be included in determining the limit. For example, the fuel limit may be transferred to the fueling station at which the driver is requesting authorization to fuel the vehicle. Once the transaction is authorized, the limit is transmitted via one or more networks and may act as an automatic shut-off for the fueling system when the limit is reached. Aspects of this automatic shut-off system may include known methods of controlling fueling systems.

In one general example of the method described above, a first reading of the cumulative fuel consumption data may be read at point A as 1,435 gallons of fuel consumed. The next reading, taken at point B may be 1,735 gallons of fuel consumed. This fuel consumption data may be transmitted to the carrier data system where the difference between the two fuel consumption values is determined to be 300 gallons. The carrier data system will then transmit a 300 gallon limit to the fueling station that the vehicle is requesting authorization at which to fuel and the vehicle will take on 300 gallons.

In some alternate arrangements, the difference between the fuel consumption values may be determined at the vehicle data system 104 and transmitted from the vehicle data system 104 to the fueling point 117. The limit may be transmitted as a volumetric measure of fuel consumed. Limiting the amount of fuel to be transferred based on the actual fuel consumed may aid in preventing fuel fraud and/or theft by controlling the amount of fuel each vehicle may take on at each fueling stop.

Figure 4:
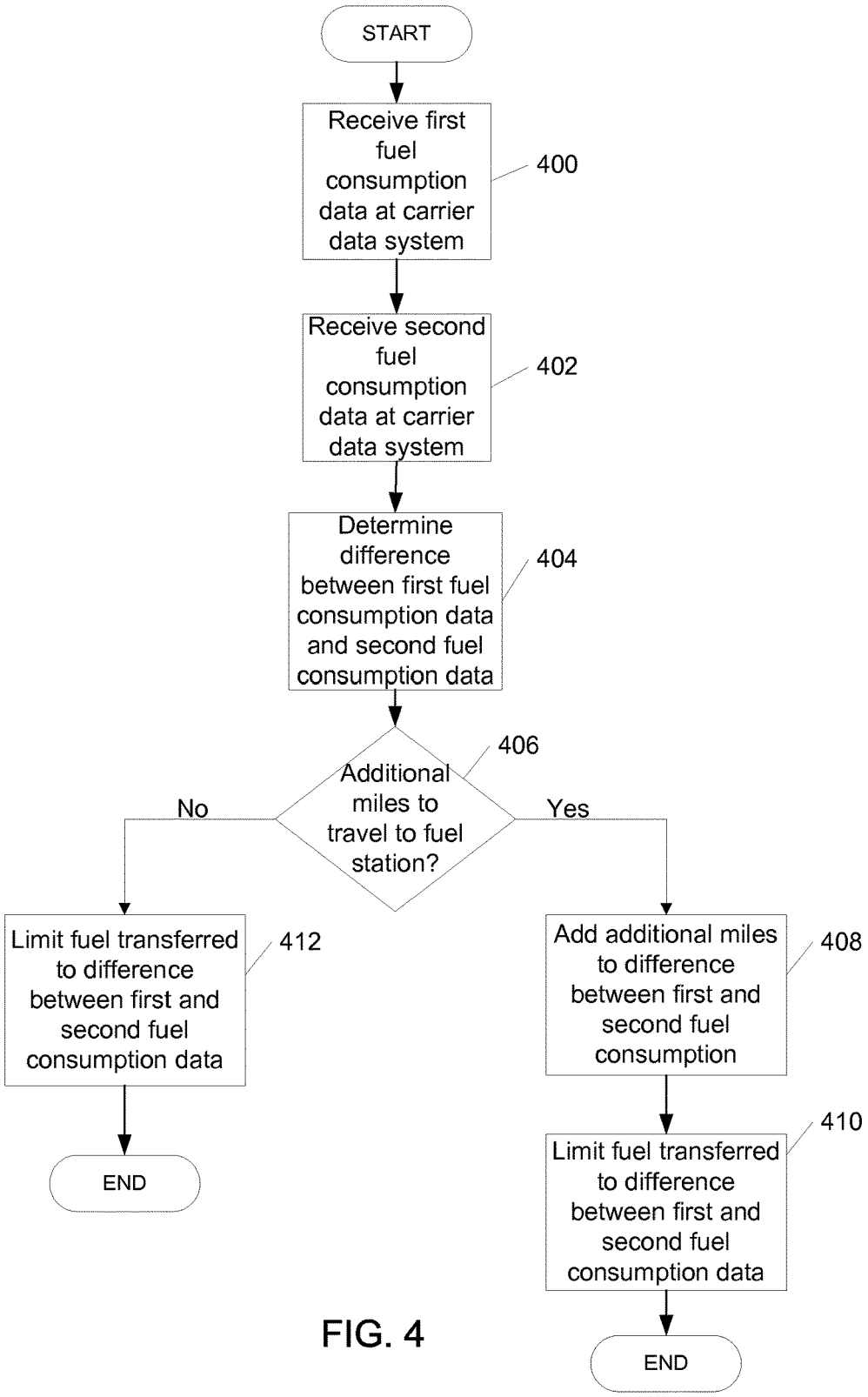
FIG. 4 is a flowchart illustrating an alternate method of regulating fuel transactions according to one or more aspects described herein.

FIG. 4 illustrates an alternate method of regulating fuel transactions. In step 400, fuel consumption data for a first predetermined point is received at the carrier data system 106. In step 402, fuel consumption data for a second predetermined point is received at the carrier data system 106. The carrier data system 106 then processes the data to determine the difference between the fuel consumption at the first and second predetermined points, in step 404. In step 406, a determination is made as to whether additional miles will be driven before the fueling transaction takes place. For instance, the second predetermined point may be a location from which the vehicle will travel an additional distance before reaching the fueling location. Accordingly, additional fuel consumption will occur beyond the second predetermined point. If additional miles will be traveled, an associated additional fuel consumption may be factored in to determine an adjusted fuel consumption for that leg of the trip, as shown in step 408. Upon determining the adjusted fuel consumption, including the consumption for the additional distance to be traveled, the carrier data system 106 will transmit the appropriate limit to the fueling station, as shown in step 410, similar as in the method illustrated in FIG. 3.

If, in step 406, no additional miles will be traveled prior to fueling, i.e., the second predetermined point is at the fueling location, then the difference between the first and second fuel consumption values will be transmitted to the fueling station as a limit to the amount of fuel that may be transferred to that vehicle, as shown in step 412, similar as in the method of FIG. 3.

Figure 5:
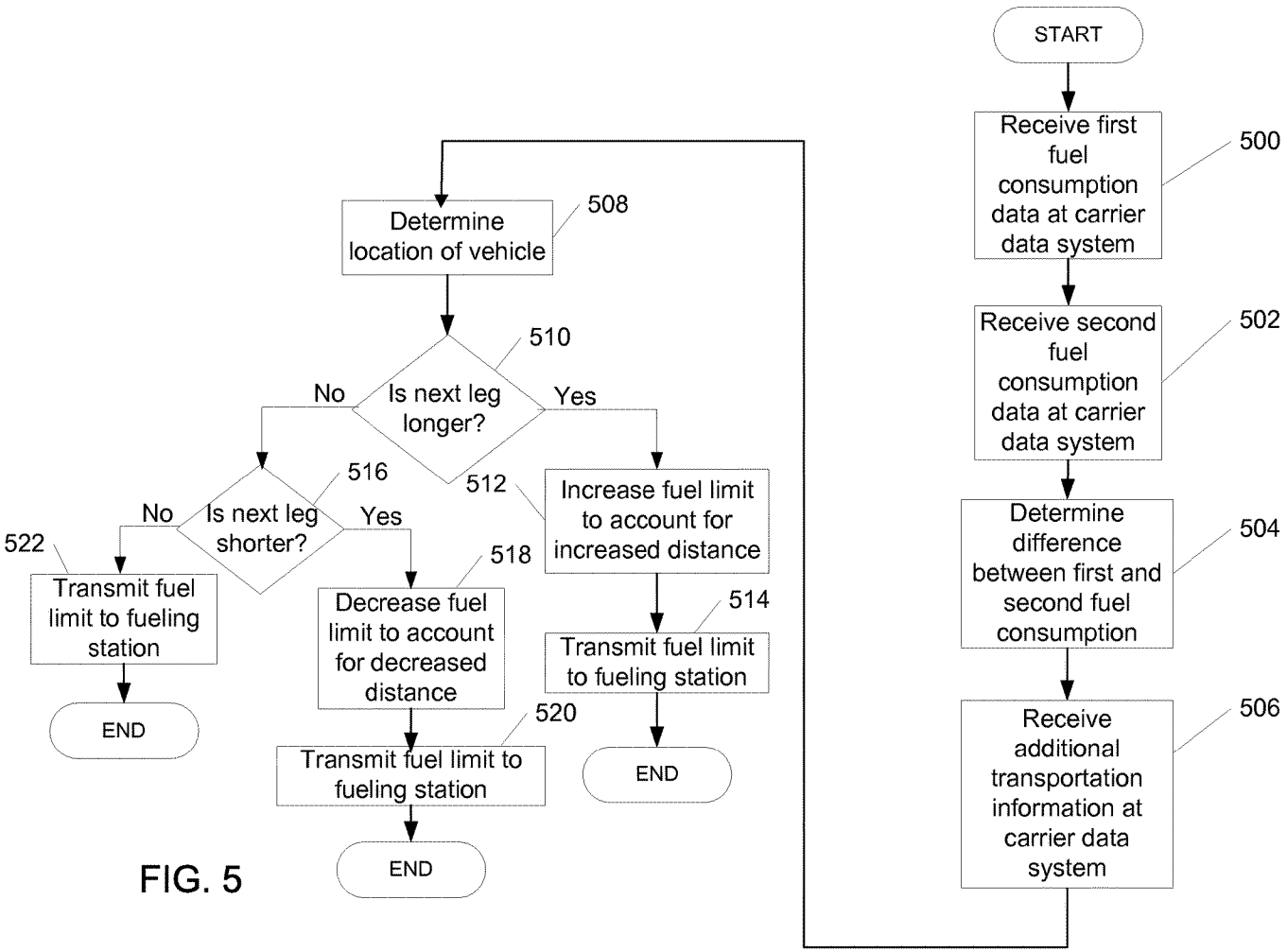
FIG. 5 is a flowchart illustrating still another method of regulating fuel transactions according to one or more aspects described herein.

FIG. 5 illustrates another example of a fuel limit transaction process. In step 500 the first fuel consumption data is received at the carrier data system 106. In step 502 the second fuel consumption data is received at the carrier data system 106. The difference between the first and second fuel consumption is determined in step 504. Step 506 includes additional transportation information being received at the carrier data system 106, including odometer readings, latitude and longitude of the vehicle, and the like. This additional information may be used in conjunction with the fuel consumption data received, to provide limits to the amount of fuel that may be transferred to a vehicle at a given fueling stop. For instance, in step 508, the latitude and longitude of the vehicle is processed to determine the location of the vehicle. This location may be compared with a projected route of the vehicle to determine if the distance to be traveled in any subsequent legs of the trip is longer or shorter than the leg for which the data is currently being processed. For instance, in step 510, a determination is made as to whether the next leg of the trip is longer than the leg for which data is currently being processed. If it is longer, the fuel consumption value is increased, in step 512, to account for an increase in distance in the next leg. In step 514 this adjusted fuel consumption is transmitted to the fueling point as the limit for the amount of fuel that can be transferred to the vehicle.

If the next leg is not longer than the current leg, a determination is made in step 516 as to whether the next leg is shorter than the leg for which data is currently being processed. If the next leg is shorter, the fuel consumption value determined is decreased to accommodate the upcoming shorter leg, as shown in step 518. In step 520 the adjusted fuel consumption is transmitted to the fueling point as the limit to how much fuel can be transferred to the vehicle. If the next leg is not shorter than the current leg, the fuel consumption determined in step 504 is transmitted to the fueling point to act as the limit, as shown in step 522.

Although not required, one of ordinary skill in the art will appreciate that various aspects described herein may be embodied as a method, a data processing system, or as one or more computer-readable storage media storing computer-executable instructions. Accordingly, those aspects may take the form of an entirely hardware embodiment, an entirely software embodiment or an embodiment combining software and hardware aspects. In addition, various signals representing data or events as described herein may be transferred between a source and a destination in the form of light and/or electromagnetic waves traveling through signal-conducting media such as metal wires, optical fibers, and/or wireless transmission media (e.g., air and/or space), as one or more computer readable transmission media.

Aspects of the invention have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps illustrated in the illustrative figures may be performed in other than the recited order, and that one or more steps illustrated may be optional in accordance with aspects of the disclosure.

I claim:

1. A method for regulating fuel transactions, the method comprising:

obtaining, by a carrier data system through a wireless communication network, vehicle operation data from an engine control module of a vehicle;

processing, by the carrier data system, the vehicle operation data to determine a first fuel consumption corresponding to a first fueling location of the vehicle;

processing additional vehicle operation data, by the carrier data system, a second fuel consumption corresponding to a second fueling location of the vehicle;

determining, by the carrier data system, a difference between the first fuel consumption and the second fuel consumption, the difference being an overall fuel consumption of the vehicle corresponding to a distance travelled between the first fueling location and the second vehicle fueling location;

determining, by the carrier data system, that an additional distance will be travelled between the first fueling location and the second fueling location and prior to fueling the vehicle;

adjusting the determined overall fuel consumption to include fuel consumption associated with the additional distance to be travelled prior to fueling the vehicle; and transmitting, through a communication network connecting the carrier data system and a fueling station control system, a fuel limit command specifying the adjusted overall fuel consumption amount to the fueling station control system, the fuel limit command causing the fueling station control system to automatically shut off a transfer fuel to the vehicle upon reaching the adjusted overall consumption amount.

2. The method of claim 1, wherein the first and second fueling locations are predetermined locations.

3. The method of claim 1, wherein the first fueling location corresponds to a start of a leg of a trip.

4. The method of claim 1, wherein the carrier data system is located remotely from the vehicle.

5. The method of claim 1, wherein the first and second fuel consumption are volumetric measures of fuel consumed.

6. The method of claim 1, wherein the first and second fuel consumption includes data received from a data bus.

7. The method of claim 1, wherein transmitting the fuel limit command includes:

determining a location of the vehicle using geographic positioning data generated by a geographic position system; and transmitting the fuel limit command to the fueling station control system ahead of the vehicle reaching a fuel station associated with the fueling station control system.

8. The method of claim 1, wherein first and second fuel consumption data is received at the carrier data system at regular intervals in a day.

9. The method of claim 1, wherein first and second fuel consumption data is received at the carrier data system on demand.

10. The method of claim 1, further including transmitting the adjusted overall fuel consumption limit from the carrier data system to the fueling station.

11. One or more non-transitory computer readable media storing computer readable instructions that, when executed, cause an apparatus to:

obtain, by a carrier data system through a wireless communication network, vehicle operation data from an engine control module of a vehicle;

process, by the carrier data system from the engine control module of the vehicle, the vehicle operation data to determine a first fuel consumption corresponding to a first fueling location of the vehicle;

process, by a carrier data system, additional vehicle operation data to determine a second fuel consumption corresponding to a second fueling location of the vehicle;

determine, by the carrier data system, a difference between the first fuel consumption and the second fuel consumption, the difference being an overall fuel consumption of the vehicle corresponding to a distance travelled between the first fueling location and the second fueling location;

determine, by the carrier data system, that an additional distance will be travelled between the first fueling location and the second location and prior to fueling the vehicle;

adjust the determined overall fuel consumption to include fuel consumption associated with the additional distance to be travelled prior to fueling the vehicle; and transmitting, through a communication network connecting the carrier data system and a fueling station control system, a fuel limit command specifying the adjusted overall fuel consumption to the fueling station control system, the fuel limit command causing the fueling station control system to automatically shut off a transfer fuel to the vehicle upon reaching the adjusted overall consumption amount.

12. The one or more non-transitory computer readable media of claim 11, wherein the first and second fueling locations are predetermined locations.

13. The one or more non-transitory computer readable media of claim 11, wherein the first fueling location is a location at a start of a leg of a trip.

14. The one or more non-transitory computer readable media of claim 11, wherein the carrier data system is located remotely from the vehicle.

15. The one or more non-transitory computer readable media of claim 11, wherein first and second fuel consumption data is received at the carrier data system at predetermined times in a day.

16. The one or more non-transitory computer readable media of claim 11, wherein first and second fuel consumption data is received at the carrier data system on demand.

17. A method of regulating fuel transactions, comprising:

obtaining, by a carrier data system through a wireless communication network, vehicle operation data from an engine control module of a vehicle;

processing, by the carrier data system from the engine control module of the vehicle, the vehicle operation data to determine a first fuel consumption data for the vehicle;

processing, by the carrier data system, additional vehicle operation data to determine a second fuel consumption data for the vehicle;

processing, by the carrier data system, the first and second fuel consumption data to determine a combined fuel consumption;

receiving, by the carrier data system, transportation information including at least a location of the vehicle;

comparing, at the carrier data system, the received transportation information with a projected route of the vehicle;

adjusting the combined fuel consumption based on a result of the comparison of the received transportation information with the projected route of the vehicle to determine a combined fuel consumption limit; and transmitting, through a communication network connecting the carrier data system and a fueling station control system, a fuel limit command specifying the combined fuel consumption limit the fueling station control system, the fuel limit command causing the fueling station control system to automatically shut off a transfer fuel to the vehicle upon reaching the combined fuel consumption amount.

18. The method of claim 17, wherein the transportation information further includes an odometer reading.

19. The method of claim 17, wherein the carrier data system is located remotely from the vehicle.

20. The method of claim 17, further including limiting an amount of fuel transferred to the vehicle based on the combined fuel consumption limit.

21. The method of claim 17, wherein the first fuel consumption data corresponds to a first predetermined location.

22. The method of claim 17, wherein the second fuel consumption data is corresponds to a second predetermined location.

23. The method of claim 17, wherein the second predetermined location corresponds to the fueling point.

* * * * *